US005700082A

United States Patent [19]

Peng

[11] Patent Number: 5,700,082

[45] Date of Patent: Dec. 23, 1997

[54] CHRISTMAS LIGHT ASSEMBLY

[76] Inventor: Juei-Tang Peng, No. 312, Yen Ping Road, Sec. 3, Hsinchu City, Taiwan

[21] Appl. No.: 739,208

[22] Filed: Oct. 29, 1996

[51] Int. Cl.[6] ..... H01R 33/00

[52] U.S. Cl. ..... 362/226; 362/249; 362/806; 439/619

[58] Field of Search ..... 362/226, 249, 362/252, 267, 391, 806; 439/619, 699.2

[56] References Cited

U.S. PATENT DOCUMENTS

| | | | |
|---|---|---|---|
| 4,679,126 | 7/1987 | VanSickler | 362/226 |
| 5,192,127 | 3/1993 | Schaef | 362/226 |
| 5,620,343 | 4/1997 | Pan | 439/699.2 |

*Primary Examiner*—Y My Quach
*Attorney, Agent, or Firm*—Morton J. Rosenberg; David I. Klein

[57] ABSTRACT

A Christmas light assembly including a lamp holder, a lamp base press-fit into the lamp holder to hold bulb, and two electrical wires having a respective conductor terminal inserted into a top insertion hole of the lamp holder into contact with the conductor wires of the bulb, wherein the insertion hole of the lamp holder is comprised of two circular wire holes linked in parallel; the lamp base has an upright rod inserted into the insertion hole of the lamp holder to separate the electrical wires and to hold them down, and a peripheral bottom flange raised around the periphery of the bottom open end thereof; the lamp holder has a rim raised around the periphery of the bottom open end thereof and press-fit into engagement with the peripheral bottom flange of the lamp base.

1 Claim, 6 Drawing Sheets

CHRISTMAS LIGHT ASSEMBLY

BACKGROUND OF THE INVENTION

The present invention relates to Christmas light assemblies, and relates more particularly to such a Christmas light assembly which firmly retains the lamp base in place when it is mounted in the lamp holder, and which effectively prohibits water from passing to the inside.

FIGS. 1 and 2 show a Christmas light assembly according to the prior art. This structure of Christmas light assembly comprises a lamp holder 63 having an axial insertion hole 631 at the top, a lamp base 62 fit into the lamp holder 63 and having two axial through holes 621, a bulb 61 press-fit into the lamp base 62 and having two conductor wires 611 inserted through the axial through holes 621 of the lamp base 62 and bilaterally retained between the lamp base 62 and the lamp holder 63, and, two electrical wires 64, 65 respectively inserted into the axial insertion hole 631 of the lamp holder 63 and having a respective conductor terminal 641, 651 respectively disposed in contact with the conductor wires 611 of the bulb 61. This structure of Christmas light assembly has drawbacks. Because the lamp holder 63 has an insertion hole 631 at the top for receiving the electrical wires 64, 65, rain water W tends to pass to the inside of the lamp holder 63 through the insertion hole 631 when the Christmas light assembly is installed outdoors. Because the lamp base 62 is press-fit into the lamp holder 63, rain water W will be accumulated inside the lamp holder 63, thereby causing an electric leakage. Because a Christmas light set or decorative string is comprised of a plurality of Christmas light assemblies connected in series, the posterior Christmas light assemblies are electrically disconnected when an electric contact error occurs in one Christmas light assembly. Another drawback of this structure of Christmas light assembly is that the lamp base tends to fall out of the lamp holder. Because the lamp base and the lamp holder are made from plastic, they tend to expand when hot, or to shrink when cold. Therefore, the connection between the lamp holder and the lamp base tends to be affected by ambient temperature. In order to stop water from passing to the inside of the lamp holder, the gap in the insertion hole of the lamp holder around the electrical wires must be sealed. However, it is not practical to seal the gap by cover means or sealing means. Because a decorative string generally comprises several hundred of Christmas light assemblies, it is time and labor consuming to seal the gap in the insertion hole of the lamp holder of each Christmas light assembly with cover means or sealing means.

SUMMARY OF THE INVENTION

The present invention has been accomplished to provide a Christmas light assembly which eliminates the aforesaid problems. It is one object of the present invention to provide a Christmas light assembly which effectively prohibits water from passing the inside. It is another object of the present invention to provide a Christmas light assembly which firmly retains the parts therein in position when assembled. According to the preferred embodiment of the present invention, the Christmas light assembly comprises a tapered, cylindrical, bottom-opened lamp holder having an axial insertion hole at a top side thereof; a tapered, cylindrical, bottom-opened lamp base fit into the lamp holder and having two axial through holes; a bulb press-fit into the lamp base and having two conductor wires inserted through the axial through holes of the lamp base and bilaterally retained between the outside wall of the lamp base and the inside wall of the lamp holder; and, two electrical wires respectively inserted into the axial insertion hole of the lamp holder and having a respective conductor terminal respectively disposed in contact with the conductor wires of the bulb, wherein the axial insertion hole of the lamp holder is comprised of two circular axial wire holes linked in parallel; the lamp holder comprises a rim raised around the periphery of a bottom open end thereof press-fit into engagement with the peripheral bottom flange of the lamp base; the lamp base comprises an upright rod axially raised from a top side thereof between the axial through holes and inserted into the axial insertion hole of the lamp holder between the circular axial wire holes to separate the electrical wires from each other, the upright rod having two longitudinal grooves at two opposite sides which receive the electrical wires respectively, and a peripheral bottom flange raised around the periphery of a bottom open end thereof; the lamp holder comprises a rim raised around the periphery of a bottom open end thereof press-fit into engagement with the peripheral bottom flange of the lamp base.

BRIEF DESCRIPTION OF THE DRAWINGS

FIG. 5A is an enlarged view of a part of FIG. 5 showing the rim of the lamp holder engaged with the peripheral bottom flange of the lamp base; and, FIG. 6 is a sectional view in an enlarged scale taken along line 6—6 of FIG. 5.

DETAILED DESCRIPTION OF THE PREFERRED EMBODIMENT

Figure 1:
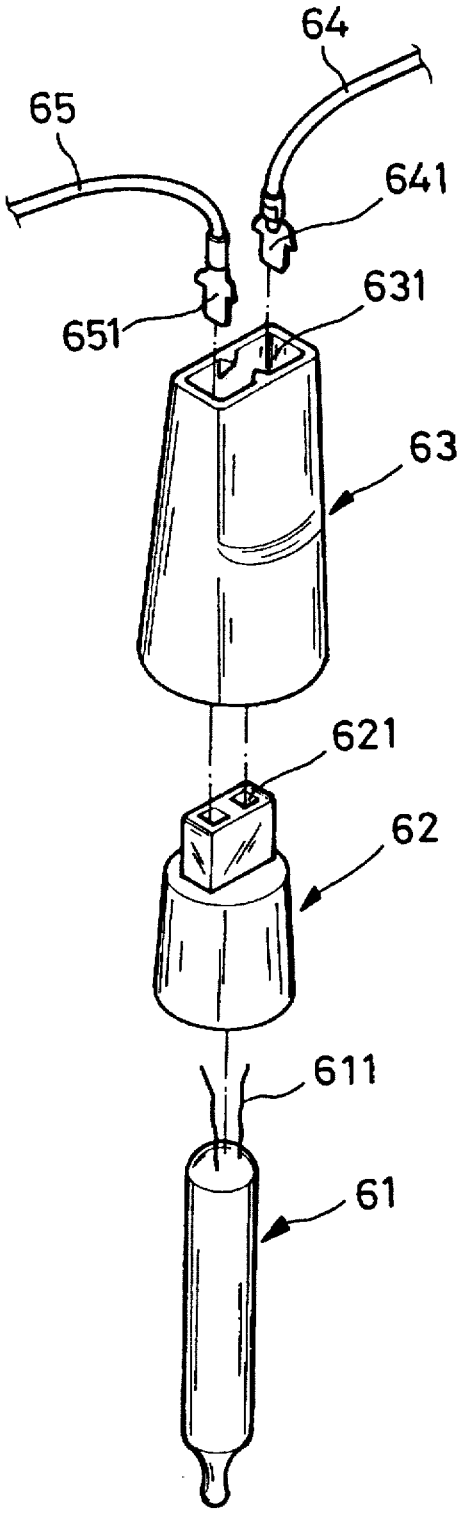
PRIOR ART FIG. 1
FIG. 1 is an exploded view of a Christmas light assembly according to the prior art.
Figure 2:
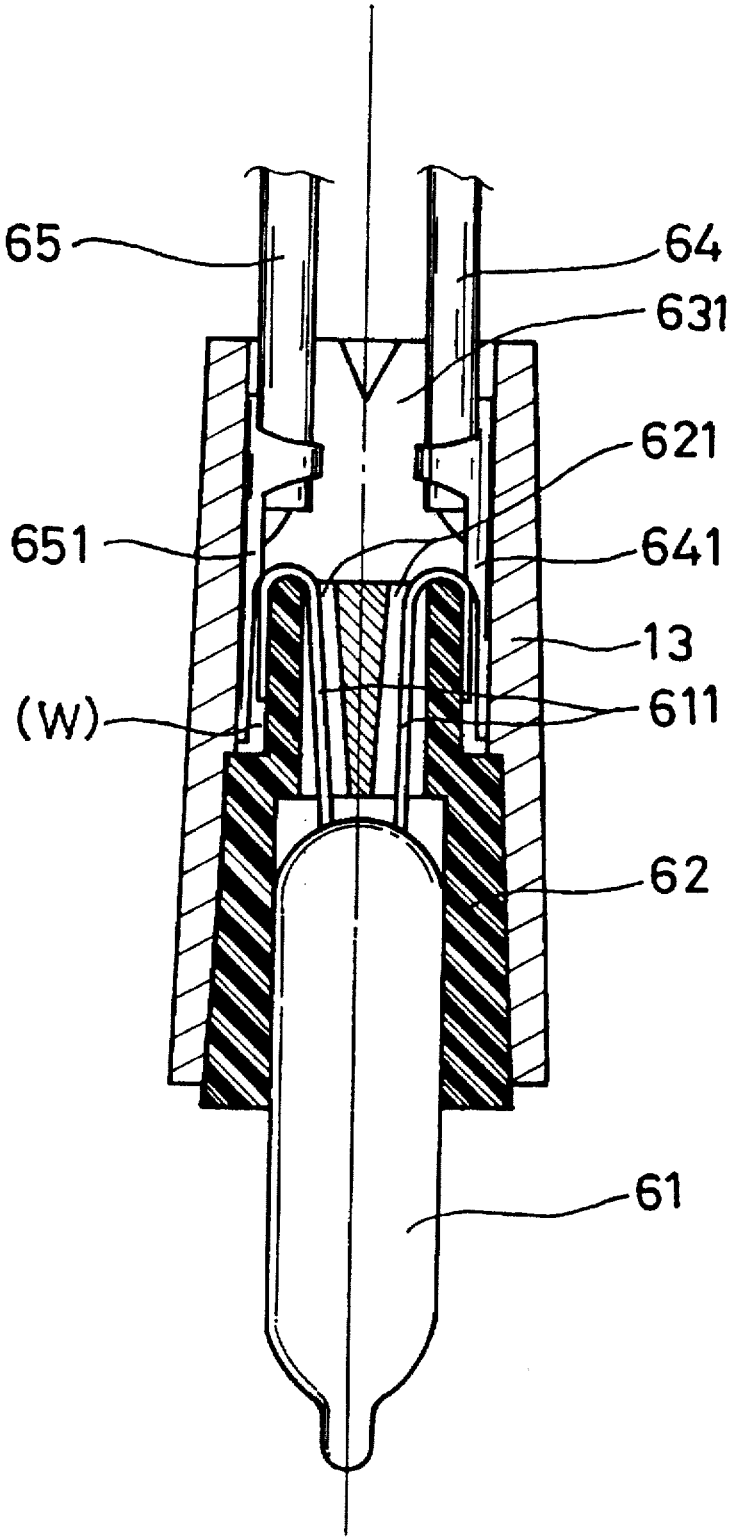
PRIOR ART FIG. 2
FIG. 2 is a sectional assembly view in en enlarged scale of the Christmas light assembly shown in FIG. 1.
Figure 3:
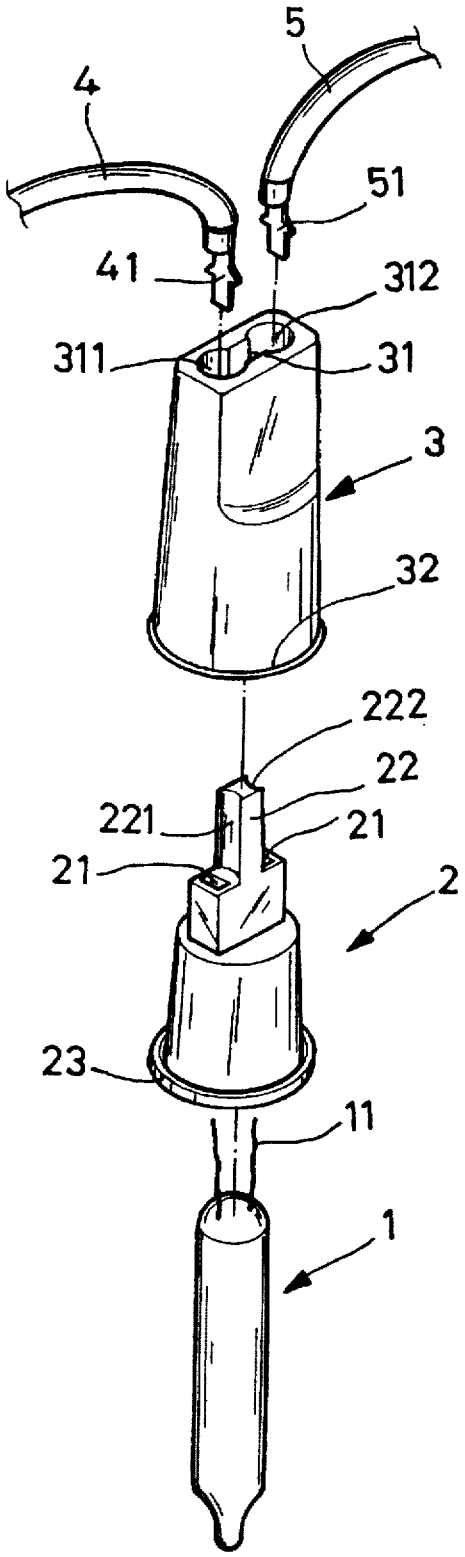
FIG. 3 is an exploded view of a Christmas light assembly according to the present invention.

Referring to FIG. 3, a Christmas light assembly in accordance with the present invention is comprised of a bulb 1 having two conductor wires 11, a tapered, cylindrical, bottom-opened lamp base 2 having two axial through holes 21 at the top for insertion of the two conductor wires 11 of the bulb 1 from the inside to the outside, a tapered, cylindrical, bottom-opened lamp holder 3 adapted for receiving the lamp base 2 to hold the bulb 1 in the lamp base 2 and having an axial insertion hole 31 at the top, and two electrical wires 4, 5 having a respective conductor terminal 41, 51 adapted for inserting into the axial insertion hole 31 of the lamp holder 3 to connect the conductor wires 11 of the bulb 1 respectively. The lamp base 2 and the lamp holder 3 are respectively injection-molded from plastic, for example, polyvinyl chloride.

The aforesaid structure is similar to a regular Christmas light assembly. The main features of the present invention are outlined hereinafter. The axial insertion hole 31 of the lamp holder 3 is comprised of two circular axial wire holes 311, 312 linked in parallel. The lamp holder 3 further comprises a rim 32 around the periphery of the bottom open end. The lamp base 2 comprises an upright rod 22 axially raised from the top between the axial through holes 21 and having two longitudinal grooves 221, 222 at two opposite sides, and a peripheral bottom flange 23 raised around the periphery of the bottom open end.

Figure 4:
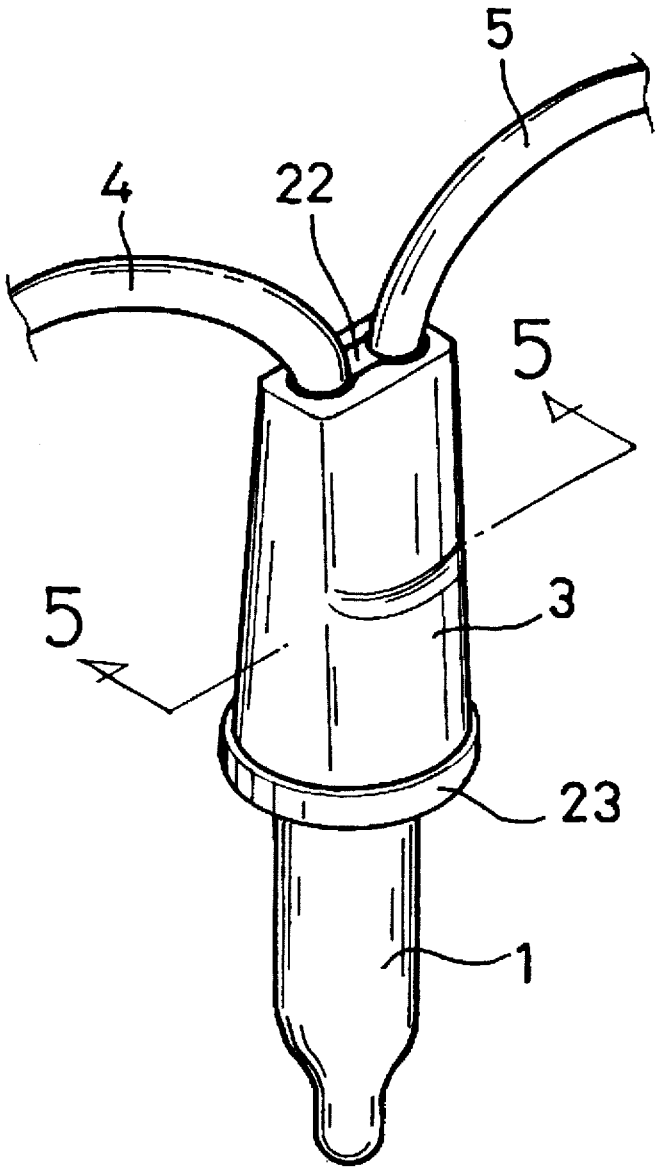
FIG. 4 is an elevational view of the Christmas light assembly shown in FIG. 3.
Figure 5:
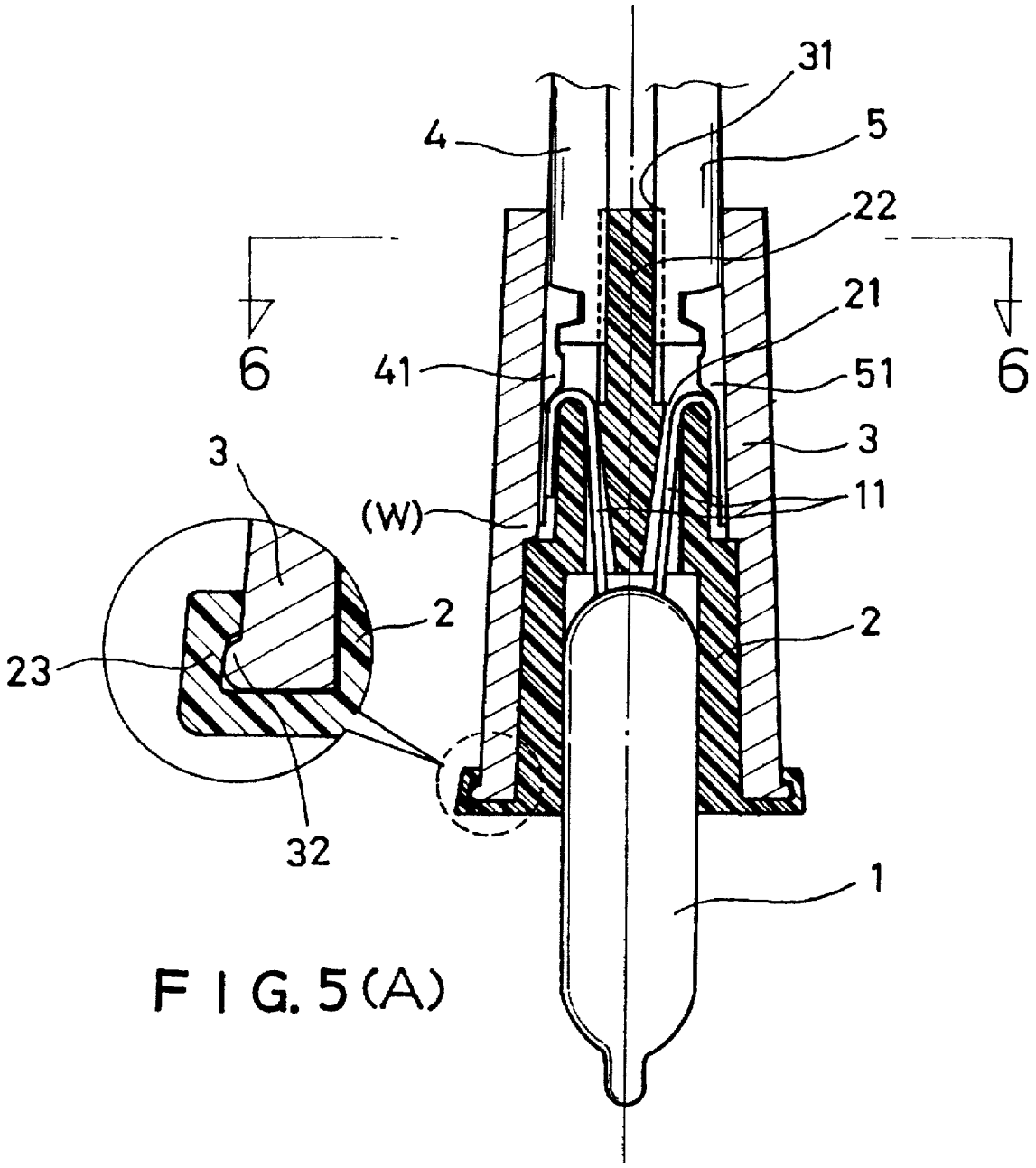
FIG. 5 is a sectional view in en enlarged scale taken along line 5—5 of FIG. 4.
Figure 6:
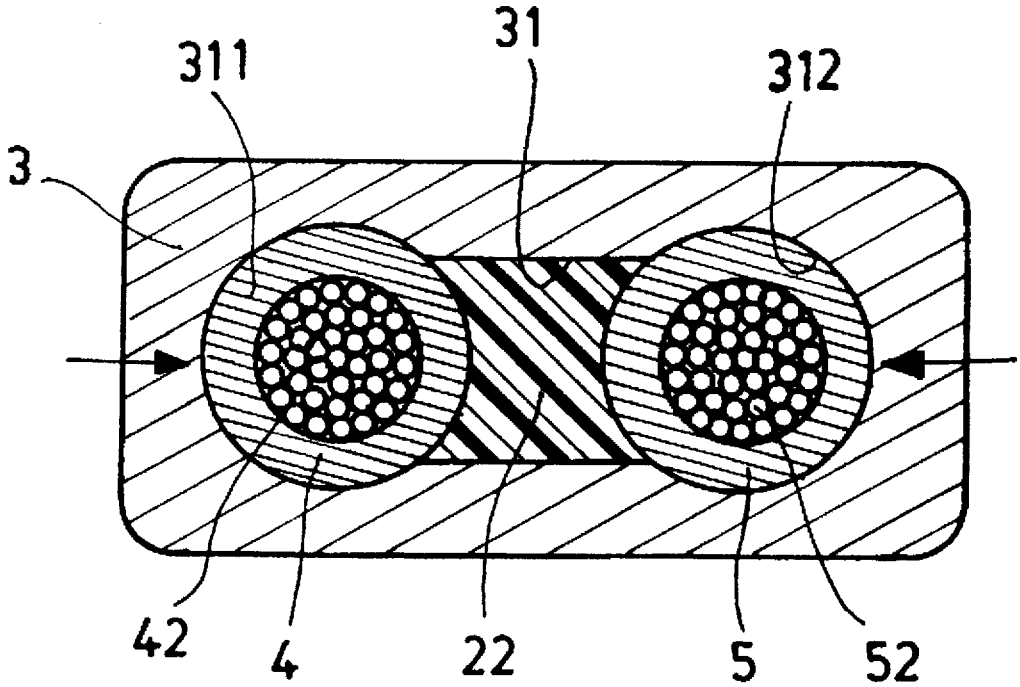

Referring to FIGS. 4, 5, and 5A, when the bulb 1 is press-fit into the lamp base 2, the conductor wires 11 are respectively inserted through the axial through holes 21 to the outside and then bilaterally bent outward and then downward to become closely attached to the outside wall of the lamp base 2, then the two electrical wires 4, 5 are respectively inserted into the circular axial wire holes 311, 312 of the lamp holder 3, and then the lamp base 2 is press-fit into the lamp holder 2, permitting the upright rod 22 to be inserted into the axial insertion hole 31 to separate the electrical wires 4, 5 from each other. When the upright rod 22 is inserted into the axial insertion hole 31, the electrical wires 4, 5 are respectively forced into engagement between the longitudinal grooves 221, 222 of the upright rod 22 and the peripheral wall of the axial insertion hole 31 of the lamp holder 3, thereby causing the conductor terminals 41, 51 to be firmly retained in contact with the conductor wires 11 of the bulb 1. At the same time, the rim 32 of the lamp holder 3 is press-fit into the gap around the periphery of the lamp base 2 within the peripheral bottom flange 23, and firmly retained engaged with the peripheral bottom flange 23 of the lamp base 2. Because the lamp base 2 and the lamp holder 3 are respectively injection-molded from plastic, the electrical wires 4, 5 are firmly retained in the axial wire holes 311, 312 between the upright rod 22 of the lamp base 2 and the periphery wall of the axial insertion hole 31 of the lamp holder 3, and at the same time the passage of the axial insertion hole 31 is blocked to stop water from passing to the inside of the lamp holder 3. Furthermore, because the rim 32 of the lamp holder 3 is engaged with the peripheral bottom flange 23 of the lamp base 2, the connection between the lamp holder 3 and the lamp base 2 is firmly secured, and water is prohibited from passing through the gap between the inside wall of the lamp holder 3 and the outside wall of the lamp base 2 to wet the conductor terminals 41, 51 of the electrical wires 4, 5, or the conductor wires 11 of the bulb 1.

It is to be understood that the drawings are designed for purposes of illustration only, and are not intended as a definition of the limits and scope of the invention disclosed.

What the invention claimed is:

1. A Christmas light assembly comprising:

a tapered, cylindrical, bottom-opened lamp holder having an axial insertion hole at a top side thereof;

a tapered, cylindrical, bottom-opened lamp base fit into said lamp holder and having two axial through holes;

a bulb press-fit into said lamp base and having two conductor wires inserted through the axial through holes of said lamp base and bilaterally retained between said lamp base and said lamp holder; and, two electrical wires respectively inserted into the axial insertion hole of said lamp holder and having a respective conductor terminal respectively disposed in contact with the conductor wires of said bulb;

wherein the axial insertion hole of said lamp holder includes two circular axial wire holes linked in parallel;

said lamp holder including a rim raised around a periphery of a bottom open end of the lamp holder press-fit into engagement with a peripheral bottom flange of said lamp base;

said lamp base including an upright rod axially raised from a top side of the lamp base between said axial through holes and inserted into the axial insertion hole of said lamp holder between said circular axial wire holes to separate said electrical wires from each other, said upright rod having two longitudinal grooves at two opposite sides of said rod which receive said electrical wires respectively, and the peripheral bottom flange being raised around a periphery of a bottom open end of the lamp base.

* * * * *